United States Patent [19]

Kimura

[11] Patent Number: 4,550,313

[45] Date of Patent: Oct. 29, 1985

[54] FIRE DETECTING SYSTEM

[75] Inventor: Tetsuo Kimura, Tokyo, Japan

[73] Assignee: Nittan Company, Limited, Tokyo, Japan

[21] Appl. No.: 495,799

[22] Filed: May 19, 1983

[30] Foreign Application Priority Data

Jun. 9, 1982 [JP] Japan ..... 57-097843

[51] Int. Cl.[4] ..... G08B 17/00

[52] U.S. Cl. ..... 340/584; 340/587; 340/628

[58] Field of Search ..... 340/628, 629, 630, 584, 340/587, 595, 589.6, 593, 501, 614, 615, 616, 661, 662; 250/339, 340, 349, 573; 307/116, 117

[56] References Cited

U.S. PATENT DOCUMENTS 4,317,113 2/1982 Honma ..... 340/630

4,459,583 7/1984 van der Walt et al. ..... 340/589

*Primary Examiner*—James L. Rowland

*Assistant Examiner*—Chi K. Lau

*Attorney, Agent, or Firm*—Abelman Frayne Rezac & Schwab

[57] ABSTRACT

A fire detecting system is disclosed, which comprises a sensor for producing an output voltage representing smoke level, heat, etc., and a comparator for producing a fire signal by comparing the output of the sensor or the differential or integral of the sensor output and a reference voltage. The sensor output or the differential or integral thereof is held in a peak hold circuit to be transferred through a switch to a sample-hold circuit for storage there.

5 Claims, 3 Drawing Figures

FIRE DETECTING SYSTEM

TECHNICAL FIELD OF THE INVENTION

This invention relates to a fire detecting system.

BACKGROUND OF THE INVENTION

A prior art fire detector comprises a sensor which outputs a voltage corresponding to smoke concentration, temperature, or the like and a comparator which compares the sensor output and a reference voltage. It produces a fire signal according to the result of the comparison, i.e., the difference between the two voltages compared. The reference voltage is set to a sensor output level corresponding to a certain smoke level, for instance, according to the type of the sensor. This setting is, of course, carried out manually. Usually the reference voltage is variable and can be set to a suitable value. Once it is set, however, it constitutes a criterion for determining whether there is a fire. Therefore, a fire signal is produced whenever the sensor output exceeds the reference voltage even when there is actually no fire. False alarms do in fact often occur with a fixed reference voltage depending upon the environment of the site of installation of the fire detector, the sensitivity fluctuations thereof and other factors. With the prior art fire detector, however, it is difficult to take effective measures to change the preset reference voltage when false alarms occur. Therefore, once a false alarm occurs, it will occur again if the same conditions are met. In some other prior art fire detectors, the time differential or integral of the sensor output is, instead of the sensor output, compared with the reference voltage. Even in this case, the drawback as discussed above cannot be avoided.

The object of the invention is to provide a fire detecting system, which overcomes the above drawback inherent in the prior art, and which permits the preset reference voltage to be changed when a false alarm occurs, thus preventing a false fire signal from being produced when the same conditions are subsequently met.

DISCLOSURE OF THE INVENTION

According to the invention, there is provided a fire detecting system which comprises a sensor which outputs a voltage representing smoke concentration, temperature, etc., and a comparator which produces a fire signal upon comparing the output of the sensor or the differential or integral of the sensor output and a reference voltage; a peak-hold circuit for holding the peak value of the sensor output or the differential or integral thereof and a sample-hold circuit capable of storing the output of the peak-hold circuit through a switch, said comparator comparing the output of the sensor or the differential or integral of the sensor output and the output of the sample-hold circuit.

In the fire detecting system according to the invention, any of various circuits can be used as the circuit for holding the peak value of the sensor output and as the circuit for holding the reference voltage. These circuits are well known to those skilled in the art, and will not be described here in detail.

In one preferred mode of the invention, a switch that is provided between the peak-hold circuit and a reference voltage hold circuit is constructed such that it is normally held open by a restoring force, and can be closed by merely pressing it and spontaneously opens again when released.

The comparator 2, sample-hold circuit 3, peak-hold circuit 4 and other components may be entirely or partially provided at a place remote from the sensor 1 and coupled therewith by a data transfer line. This is the reason why we call the apparatus of this invention a system. In the following description of same embodiments of the invention, however, apparatuses are called "fire detector", since all the above mentioned circuits are described as being located at one place.

BRIEF DESCRIPTION OF THE DRAWINGS

The above objects, features and advantages of the invention will become more apparent from the following description when the same is read with reference to the accompanying drawings, in which.

SPECIFIC DESCRIPTION OF THE INVENTION

Figure 1:
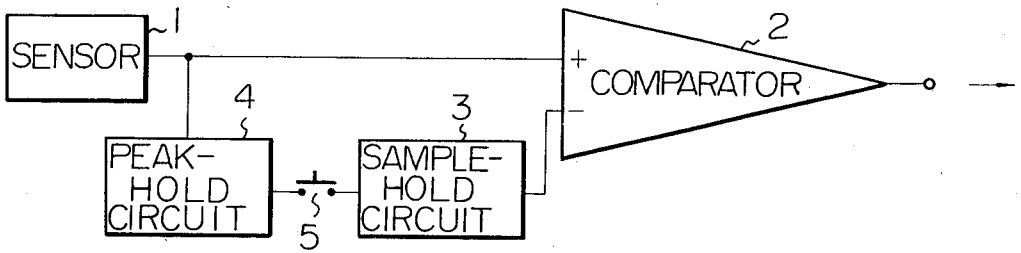
FIG. 1 is a block diagram showing an embodiment of the invention.

FIG. 1 is a block diagram showing an embodiment of the fire detector according to the invention. The illustrated fire detector has a sensor 1, which may, for instance, be an ionization type smoke sensor which produces an output voltage proportional to the detected smoke level. The output voltage of the sensor 1 is fed to one of the input terminals of a comparator 2. It is compared with the output of a sample-hold circuit 3 fed to the other input terminal of the comparator 2. An initially set voltage is stored in the sample-hold circuit 3. In order for the initial voltage to be stable for a long time, it is desirably stored in digital form. In this case, the sensor 1 is of course adapted to provide its output in digital form. The output of the sensor 1 is also fed to a peak-hold circuit 4, which holds the peak value of the sensor output. Assume now that the output voltage of the sensor 1 increases, for instance due to cigarette smoke and produces an output voltage higher than the preset intitial voltage held in the sample-hold circuit 3. Then, the comparator 2 produces a fire signal. When the smoke disappears, the output voltage of the sensor 1 decreases. However, the peak value of the output of the sensor 1 is held in the peak-hold circuit 4. Meanwhile, the person (e.g. a watchman) alerted by the fire alarm will find that no fire has occurred upon visiting the site of the fire detector. At this time if the watchman closes a switch 5, the peak value held in the peak-hold circuit 4 is stored in the sample-hold circuit 3. The switch 5 is a normally open switch, such as a push-button switch that is biased to the open position and which is held in the open position and which is held in the open position by a restoring force, the switch being closed by merely pressing it, and being automatically opened by the restoring force when it is released. In this condition, the comparator 2 will not produce a fire signal even if the same level of smoke is detected. Thus, the repeated occurrence of a false alarm can be prevented. Of course, a false alarm may be produced when a higher cigarette smoke level is sensed. In such a case, the peak value is again stored in the sample-hold circuit 3 in the manner described above. When an actual fire is detected, the comparator 2 of course produces a fire signal. If the sensor 1 in the above embodiment is not an ionization smoke sensor but a sensor of a different type, e.g., a light scattering type smoke sensor or a heat sensor, the same effects may also be obtained. In this case, too, the peak value of the sensor output produced when there is no fire can be stored in a sample-hold circuit of the same construction. Generally, the output voltage of the sensor 1 is not fixed but varies from minute to minute. With the prior art fire detector, it has been practically impossible to change the preset reference voltage level. With the fire detector according to the invention, it can be easily reset to a more suitable value by merely operating the switch 5. The possibility of generation of a false alarm can thus be reduced or eliminated.

Figure 2:
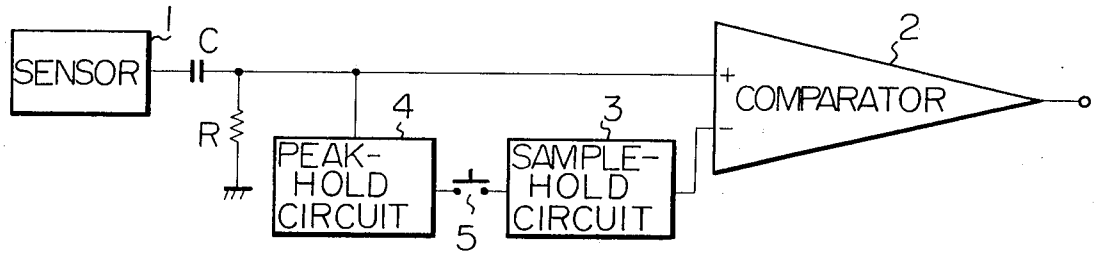
FIG. 2 is a block diagram showing a second embodiment of the invention.

FIG. 2 shows a different embodiment of the invention. In this instance, the occurrence of fire is judged by means of the differential of the output of sensor 1. The sensor 1 in this case is a heat sensor, so that its output level differs with the seasons and also increases when the room is heated. The judgment regarding occurrence of a fire is made based on the time differential of the sensor output lest the detector should judge slow temperature rise as being caused by a fire. In this case the invention is suitably applied. That is, the output of the sensor 1 is differentiated through a differentiator consisting of a capacitor C and a resistor R. The differential is fed to the comparator 2 and the peak-hold circuit 4. A suitable initial value is set in the sample-hold circuit 3. As in the preceding embodiment, the peak value of the differential output when there is no fire is held in the peak-hold circuit 4 and can be transferred to the sample-hold circuit 3 when the switch 5 is closed.

Figure 3:
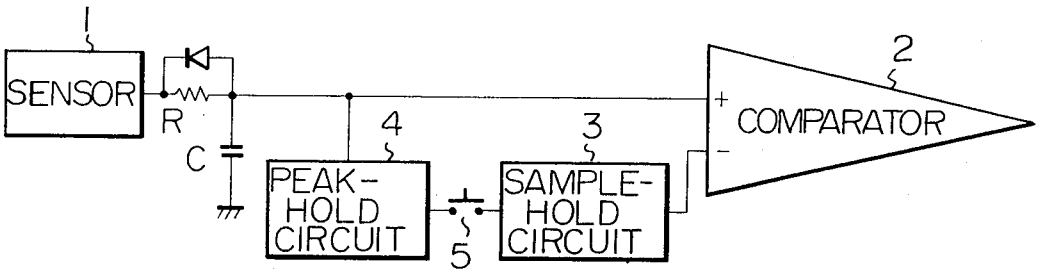
FIG. 3 is a block diagram showing a third embodiment of the invention.

FIG. 3 shows a further embodiment of the invention, which is applied to a fire sensor which makes a judgment as to whether there is a fire on the basis of the integral of the sensor output. The output of the sensor 1 is fed through an integrator consisting of a resistor R and a capacitor C to the comparator 2 and also to the peak-hold circuit 4. Again in this instance, the peak value of the integral when there is no fire can be stored in sample-hold circuit 3.

The above embodiments of the invention may be used in combination. When two or more circuits of the above embodiments are combined, a single sensor may be used in common for these circuits. Further, the differentiator and integrator may be constructed as digital processing circuits as well as analog circuits. Further, two or more of the above embodiments may be combined such that a fire signal is produced as an OR or AND or any other suitable combination of the individual comparator outputs. In this case, it is desirable to employ means to prevent the content of each sample-hold circuit from being changed to a value lower than the already stored value. For example, it is easy to provide an arrangement whereby the content of the sample-hold circuit is revised only when the content of the peak-hold circuit is greater than the content of the sample-hold circuit. Needless to say, the above-described functions can be implemented by means of a microprocessor. Further, the comparator 2, sample-hold circuit 3, peak-hold circuit 4 and other components may be entirely or partially provided of a place remote from the sensor 1 and coupled therewith by a data transfer line. That is, all the components of the fire detector need not be located at one place.

As has been described in the foregoing, according to the present invention the content of the sample-hold circuit can be renewed according to the content of the peak-hold circuit for holding the peak value of the sensor output (or the differential or integral thereof), and a fire signal is provided depending upon the result of a comparison of the output level of the sample-hold circuit and the sensor output level (or the differential or integral level of the sensor output). The peak value of the sensor output when there is no fire thus can be readily transferred to the sample-hold circuit, and the repeated occurrence of false alarms can be greatly reduced.

I claim:

1. A fire detecting systems comprising:

a sensor which outputs a voltage corresponding to smoke concentration, temperature or the like;

a comparator which compares the output voltage of the sensor with a reference voltage to produce a fire alarm when the output voltage of the sensor exceeds the reference voltage;

a peak-hold circuit which holds a peak voltage of the output of the sensor;

a sample-hold circuit which is capable of storing the output voltage of the peak-hold circuit to supply the stored voltage to the comparator as the reference voltage;

a switch means which is capable of transferring the output voltage of the peak-hold circuit to the sample-hold circuit.

2. A fire detecting system comprising:

a sensor which outputs a voltage corresponding to smoke concentration, temperature of the like;

a differentiator which differentiates the output voltage of the sensor;

a comparator which compares the output voltage of the differentiator with a reference voltage to produce a fire alarm when the output voltage of the differentiator exceeds the reference voltage;

a peak-hold circuit which holds a peak voltage of the output of the sensor;

a sample-hold circuit which is capable of storing the output voltage of the peak-hold circuit to supply the stored voltage to the comparator as the reference voltage;

a switch means which is capable of transferring the output voltage of the peak-hold circuit to the sample-hold circuit.

3. A fire detecting system comprising:

a sensor which outputs a voltage corresponding to smoke concentration, temperature or the like;

an integrator which integrates the output voltage of the sensor;

a comparator which compares the output voltage of the integrator with a reference voltage to produce a fire alarm when the output voltage of the integrator exceeds the reference voltage;

a peak-hold circuit which holds a peak voltage of the output of the sensor;

a sample-hold circuit which is capable of storing the output voltage of the peak-hold circuit to supply the stored voltage to the comparator as the reference voltage;

a switch means which is capable of transferring the output voltage of the peak-hold circuit to the sample-hold circuit.

4. A fire detecting system according to claim 1, 2 or 3, wherein the sensor produces an output voltage representing a heat level.

5. A fire detecting system according to claim 1, 2 or 3, wherein the switch is held open by a restoring force, is closed by merely pressing it, and is opened again when released.

* * * * *